United States Patent [19]

Ruth, Jr.

[11] Patent Number: 4,525,941

[45] Date of Patent: Jul. 2, 1985

[54] MUD WALKER

[76] Inventor: George F. Ruth, Jr., 101 Haussler Rd., Kelso, Wash. 98626

[21] Appl. No.: 572,536

[22] Filed: Jan. 20, 1984

[51] Int. Cl.[3] ..... A43B 5/04

[52] U.S. Cl. ..... 36/116

[58] Field of Search ..... 36/116, 7.5

[56] References Cited

U.S. PATENT DOCUMENTS

| | | | |
|---|---|---|---|
| 683,595 | 10/1901 | Drouillard | 36/116 |
| 1,266,492 | 5/1918 | Kurrell et al. | 36/116 X |
| 2,367,219 | 1/1945 | Kearny | 36/116 X |
| 2,412,474 | 12/1946 | Paine et al. | 36/116 X |
| 2,430,466 | 11/1947 | Hedman | 36/116 X |
| 2,720,714 | 10/1955 | Krohn et al. | 36/116 X |
| 3,423,852 | 1/1969 | Smith | 36/7.5 |
| 4,447,969 | 5/1984 | Johnson | 36/116 |

*Primary Examiner*—Louis K. Rimrodt

*Attorney, Agent, or Firm*—Lee R. Schermerhorn

[57] ABSTRACT

A platform is supported around the periphery of its under surface by a pneumatic tube cushion secured to the platform by strap loops. The top side of the platform is equipped with adjustable means of securement to the shoe or boot of the user. Vent holes in mid portions of the platform prevent suction effects under the platform when the foot is lifted. The device is collapsible into a compact package for shipment or storage.

10 Claims, 7 Drawing Figures

MUD WALKER

This invention relates to an attachment for a shoe or boot to enable a person to walk on deep mud without sinking in.

BACKGROUND OF THE INVENTION

Just as snowshoes enable a person to walk on loose snow there is a need for some device to enable a person to walk on mud flats of tide land, on marshes and on soft arctic tundras. It is desirable that the device be collapsible into a compact package for shipping and storage.

Such a device is needed by duck hunters, the oyster industry, fishermen in the bays of Alaska and for gathering shrimp and mud clams.

SUMMARY OF THE INVENTION

The present mud walker comprises a platform supported on its underside by an inflated resilient tube extending around the periphery of the platform and secured by strap loops. The top side of the platform is equipped with adjustable means of securement to the shoe or boot of the user. Vent holes in mid portions of the platform prevent suction effects under the platform when the foot is lifted. The device is collapsible into a compact package by deflating the pneumatic tube and folding down the shoe securement parts.

The resilient air-inflated tube provides not only the ability to stay on the surface of deep, soft mud but also has a leveling effect for walking on rough, hard ground making such walking much easier. When used in cranberry bogs the soft supporting cushion inflicts a minimum of damage to the crops.

The invention will be better understood and additional objects and advantages will become apparent from the following description of the preferred embodiment illustrated in the accompanying drawings. Various changes may be made in the details of construction and arrangement of parts and certain features may be used without others. All such modifications within the scope of the appended claims are included in the invention.

DESCRIPTION OF THE PREFERRED EMBODIMENT

Figure 7:
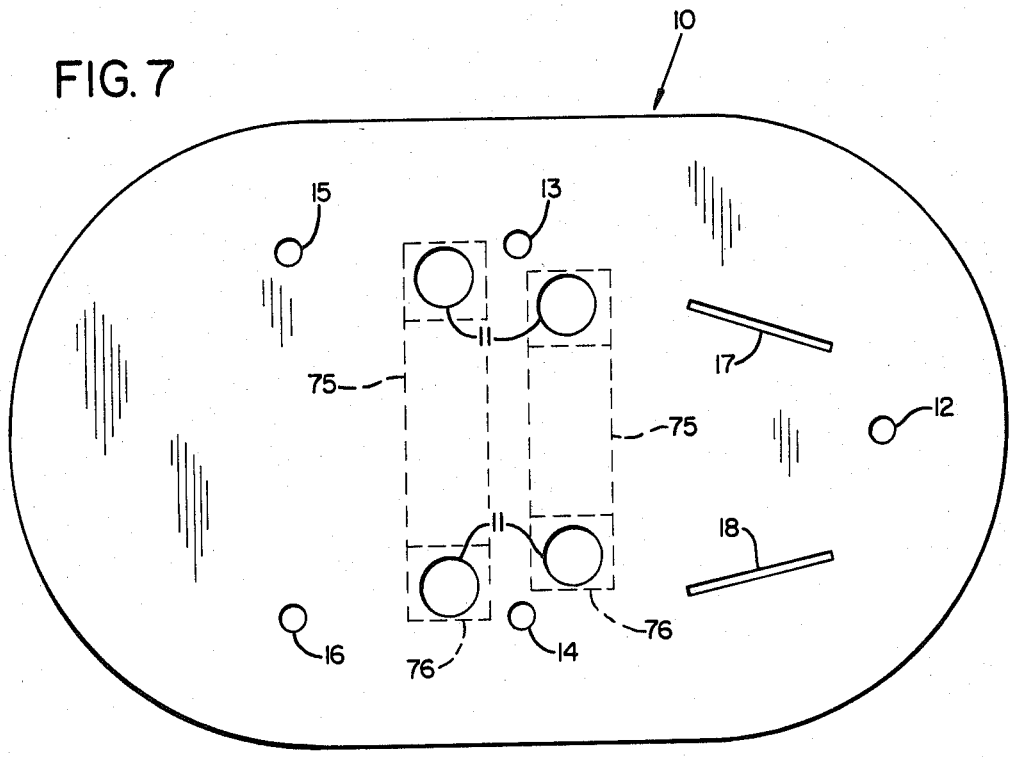
FIG. 7 is a top plan view of the platform.

Referring first to FIG. 7, the platform 10, which may be made of plywood or other suitable material, is provided with a number of holes for various purposes. There are four air vent holes 11, a front strap hole 12, two strap holes 13 and 14 on opposite sides at intermediate length and two strap holes 15 and 16 on opposite sides near the rear end. Near the front end are two toe belting slots 17 and 18.

Figure 4:
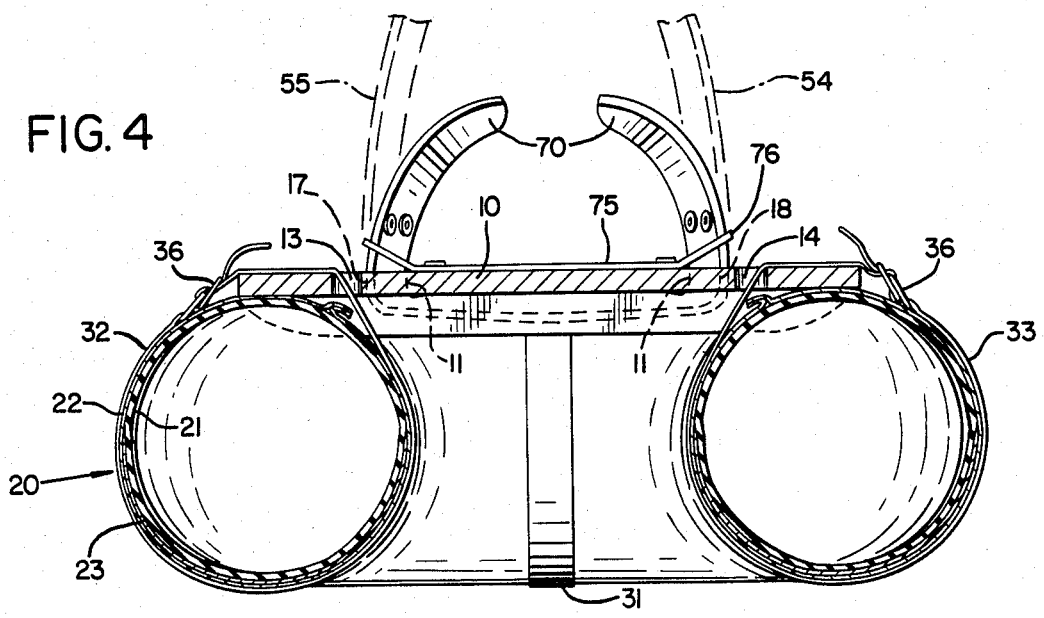
FIG. 4 is a sectional view on the line 4—4 in FIG. 1.
Figure 5:
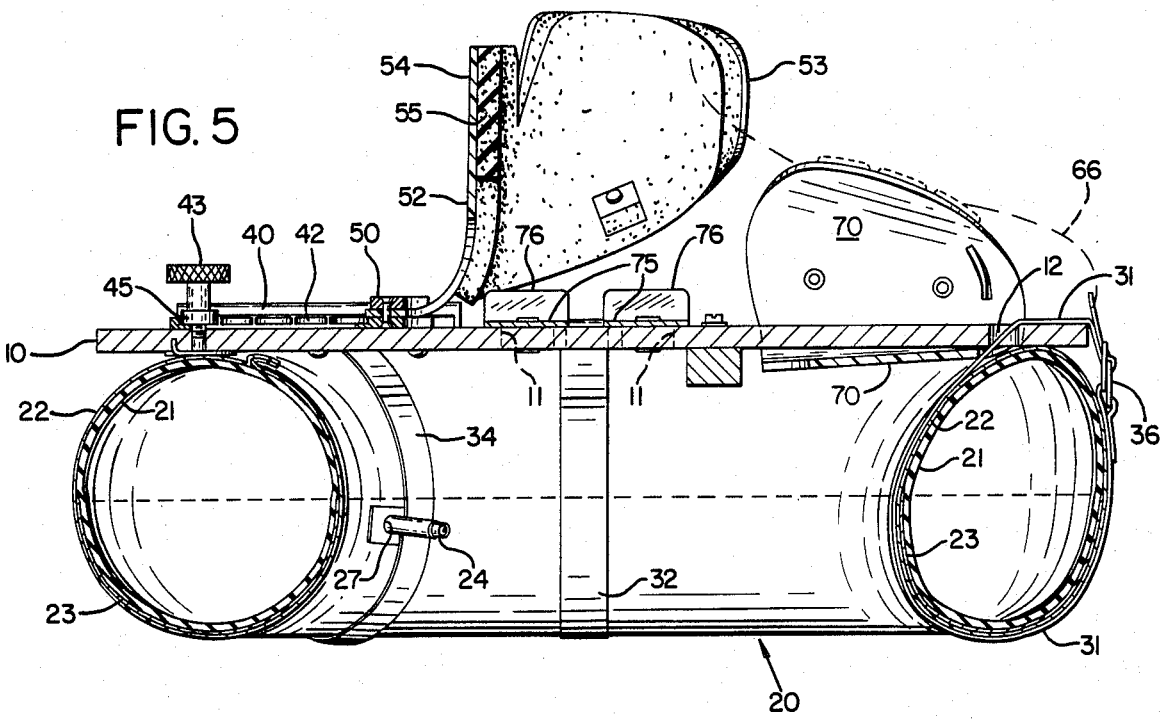
FIG. 5 is a sectional view on the line 5—5 in FIG. 1.

As best seen in FIGS. 4 and 5 the platform 10 is supported on a peripheral cushion member 20 comprising a resilient pneumatic tube 21 enclosed in a protective nylon cloth tube 22. Cloth tube 22 is preferably reinforced on its underside by a second layer of nylon cloth 23 stitched to cloth 22. In the present embodiment pneumatic tube 21 is an inner tube designed for the tire on a wheel of a boat trailer. This inner tube has the usual valve stem 24 for inflation by a tire pump to the pressure desired.

Figure 6:
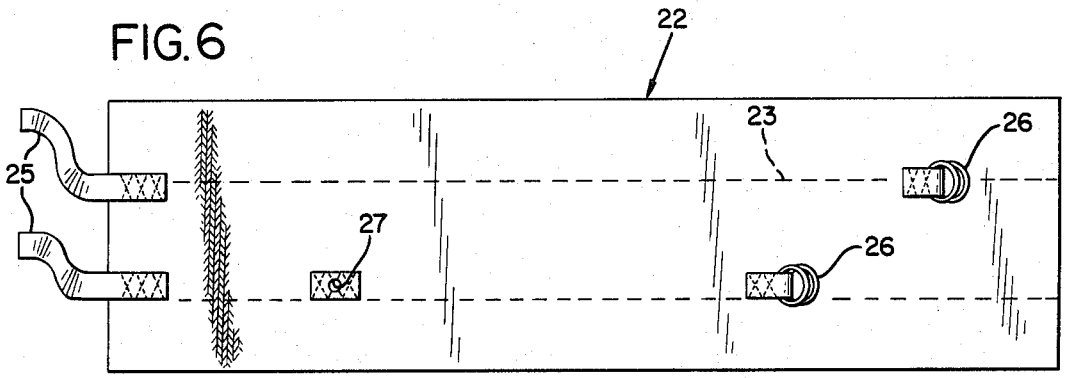
FIG. 6 is a plan view of the cover for the inflated tube.

The side edges of cloth 22 are stitched together on the top side of inner tube 21 and the opposite ends are secured together in overlapping relation by two strips of belting 25 on one end secured in D-rings 26 adjacent the other end as seen in FIG. 6. The cloth 22 thus provides a replaceable wear-resistant covering for the inner tube 21. Valve stem 24 projects through a reinforced hole 27 in the cloth layers 22 and 23.

Figure 1:
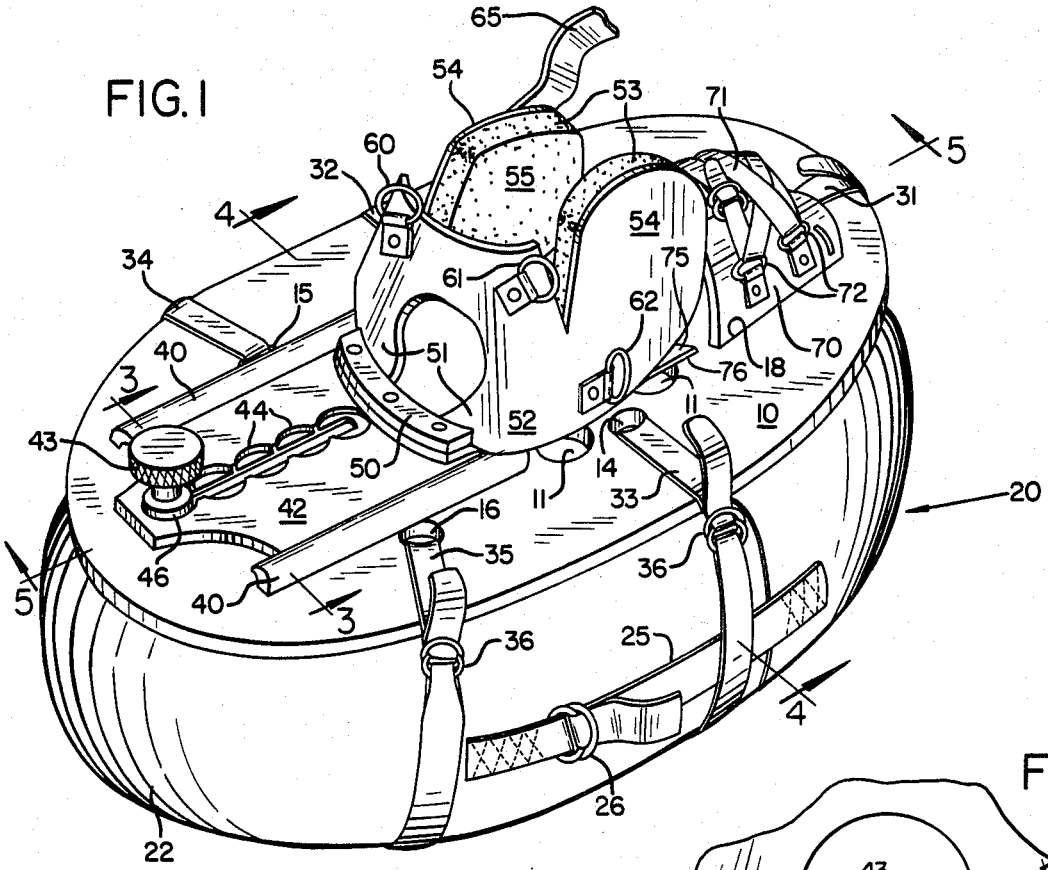
FIG. 1 is a perspective view of a mud walker embodying the invention.

The cushion member just described is secured to the underside of platform 10 by five straps as shown in FIG. 1. A front strap 31 is looped around the cushion member and passed through strap hole 12. Near mid-length of the platform a left strap 32 passes around the cushion member and through strap hole 13 and a right strap 33 passes in a similar manner through strap hole 14. Towards the rear of the platform strap 34 passes through strap hole 15 and strap 35 passes through strap hole 16. One end of each strap is equipped with lock rings 36 for securement to the opposite end of the strap.

Figure 3:
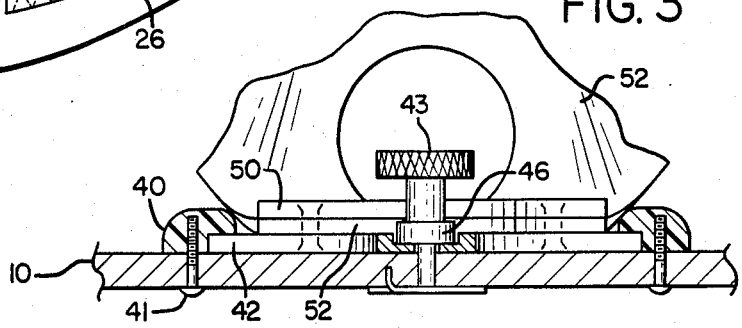
FIG. 3 is a fragmentary view on the line 3—3 in FIG. 1.

The means of adjustable securement of the shoe or boot heel is best shown in FIG. 1. A pair of flanged rails 40 is secured to the top of the platform in parallel relation by screws 41 in the underside of the platform as shown in FIG. 3. An adjustment plate 42 is slidable under the flanges of rails 40 and clamped in a selected position by a clamp bolt 43. Adjustment plate 42 has a longitudinal slot to slide on the shank of bolt 43, the slot having a series of enlargements 44 to receive a flange 45 on the bolt in different positions of adjustment.

Figure 2:
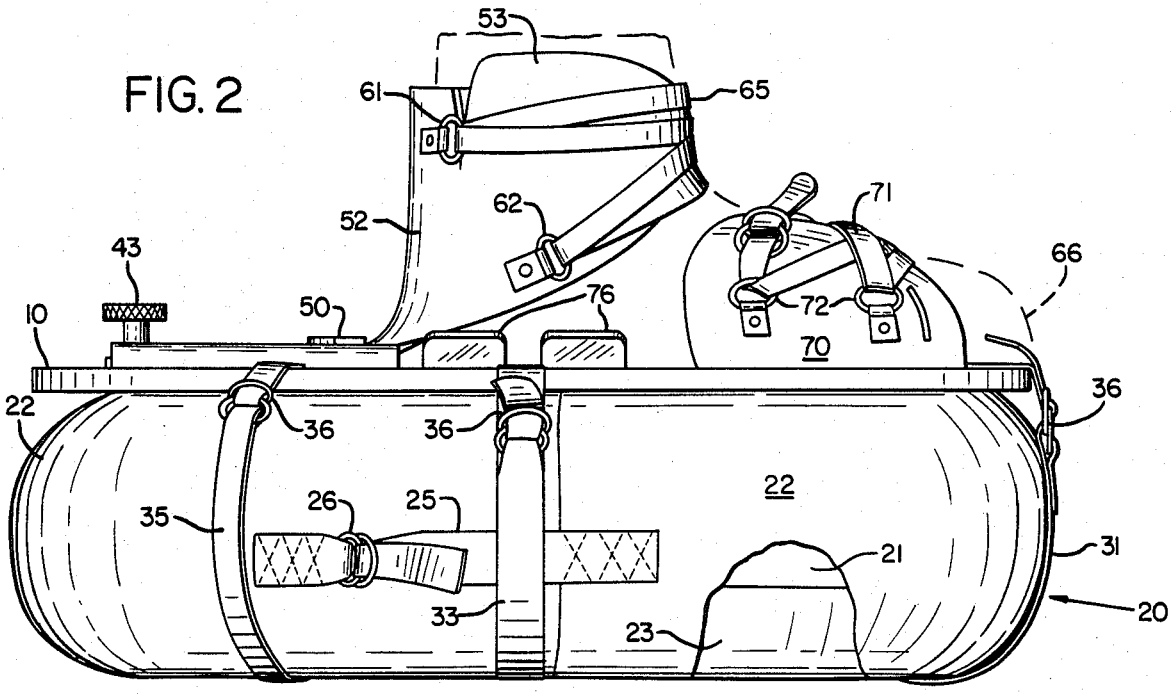
FIG. 2 is a side elevation view.

A cleat 50 on adjustment plate 42 secures two lower arm 51 of a flexible heel belting 52. Heel belting 52 has a pair of forward side wings 53 to fold around and overlie portions of the instep and ankle of the user as shown in FIG. 2. This heel belting comprises an outside layer 54 of smooth water proof plastic having an inside cushion layer 55 of non-absorbent soft plastic material.

The back heel portion of heel belting 52 is equipped with a pair D-rings 60 and 61 and the lower side portions are equipped with a D-ring 62 on the right and a similar D-ring in a corresponding position on the left side. One end of a nylon strap 65 is anchored at the latter position for criss-crossing the instep and ankle as shown in FIG. 2 with the free end being secured to lock rings on the anchored end. Strap 65 holds the heel down securely on platform 10 without allowing the heel to rise as it does in a ski binding.

The toe of the shoe or boot 66 is secured by a toe belting 70 comprising a flat strip of plastic material having its central portion on the underside of platform 10 with its ends extending upward through slots 17 and 18. These ends are secured over the toe of the shoe or boot by a strap 71 similar to the strap 65 which passes through D-rings 72 on opposite sides of the foot and is secured by D-ring fastening means.

Air vent holes 11 allow outside air to pass into the space under the platform which is enclosed by the cushion ring 20 so that the platform may be readily lifted in walking without producing a suction effect. A pair of baffle plates 75 on top of the platform have raised ends 76 projecting above the holes 11 to maintain the air passageways through these holes clear and open.

Thus the hollow cushion 20 provides a large area of contact to support the user on the surface of soft mud and this area of contact may be adjusted for different conditions by the amount of air pressure pumped into inner tube 21 through valve stem 24. Also, in an extreme condition of softness of the mud surface the underside of platform 10 provides considerable additional supporting surface when necessary. Under all conditions the vent holes 11 prevent any suction effect to resist lifting of the foot.

Another advantage of the present form of construction is its compactness for shipping and storage. The heel and toe securement means 52 and 70 fold down against the top of platform 10 and when the air is let out of tube 21 the cushion 20 flattens against the under side of the platform to made a compact package.

In the event of a puncture in tube 21 the straps 25 are released from rings 26 and valve stem 24 is withdrawn from hole 27 in cloth tube 22. Then the tube 21 may be pulled around in cloth tube 22 to expose the puncture in a space between the separated ends of the cloth tube so that the puncture may be repaired.

The same mud walker is used for both the left foot and the right foot. There is no strap 25 on the left side of the mud walker to catch on the strap 25 or ring 26 on the other foot.

What is claimed is:

1. A mud walker comprising a platform, an elliptical flexible compressed air tube supporting only marginal portions of said platform, an air connection for inflating said tube with compressed air, a flexible and inelastic protective covering on said compressed air tube, means securing said compressed air tube and covering to said marginal portions of the underside of said platform leaving an open space under the center of the platform, air vent holes in said central portion of said platform spaced away from said compressed air tube and communicating with said open space under the platform, baffles spaced above said air vent holes, and means on the upper side of said platform for attachment to the foot of a wearer.

2. A mud walker as defined in claim 1, said means securing said compressed air tube and covering to said platform comprising straps passing through holes in said platform.

3. A mud walker as defined in claim 2, said straps and said compressed air tube and covering being removable from said platform and said covering being removable from said compressed air tube.

4. A mud walker as defined in claim 1, said attachment means comprising toe and heel securement means to hold the toe and heel portions of the wearer's foot firmly against said platform.

5. A mud walker as defined in claim 1, said toe securement means comprising a pair of flexible wings extending upward from said platform, and strapping interconnecting said wings across said toe portion of the wearer's foot.

6. A mud walker as defined in claim 4, said heel securement means comprising a flexible rear heel wing extending upward from said platform, a pair of flexible side heel wings connected to opposite side edges of said rear wing, strapping fastening and guide means on said wings, and strapping in said fastening and guide means to cross over the instep and ankle of the wearer's foot.

7. A mud walker as defined in claim 6 including cushion material on the inside surfaces of said wings.

8. A mud walker as defined in claim 6 including foot length adjustment means for said heel securement means.

9. A mud walker as defined in claim 8, said adjustment means comprising a pair of guides on said platform, an adjustment plate slidable in said guides, means to secure said plate in adjusted position, and means to fasten the lower end of said rear heel wing to said adjustment plate.

10. A mud walker as defined in claim 1 said platform comprising a plywood panel.

* * * * *